US006438995B1

(12) United States Patent
Kuptzin et al.

(10) Patent No.: US 6,438,995 B1
(45) Date of Patent: Aug. 27, 2002

(54) CLASP FOR JEWELRY CHAIN

(76) Inventors: Ronald S. Kuptzin, 27 Rossie St., Mystic, CT (US) 06355; Cynthia G. Kuptzin, 27 Rossie St., Mystic, CT (US) 06355

( * ) Notice: Subject to any disclaimer, the term of this patent is extended or adjusted under 35 U.S.C. 154(b) by 0 days.

(21) Appl. No.: 09/619,286

(22) Filed: Jul. 19, 2000

(51) Int. Cl.[7] ..... A44C 5/00; A44B 11/25
(52) U.S. Cl. ..... 63/3.1; 63/3; 63/3.2
(58) Field of Search ..... 63/3, 3.1, 3.2; 24/574.1, 709.8, 710, 709.6, 573.1

(56) References Cited

U.S. PATENT DOCUMENTS

| | | | | |
|---|---|---|---|---|
| 686,068 A | | 11/1901 | Herrick et al. | |
| 2,351,569 A | * | 6/1944 | White | 24/710 |
| 2,551,063 A | * | 5/1951 | Sneirson | 24/709.8 |
| 3,001,259 A | * | 9/1961 | Scheemaeker | 24/709.6 |
| 3,136,014 A | * | 6/1964 | Nickerson | 24/709.6 |
| 4,549,411 A | | 10/1985 | Ivey | |
| 4,628,708 A | | 12/1986 | Ivey | |
| 4,651,541 A | | 3/1987 | Farley | |
| 4,686,746 A | | 8/1987 | Lockhart | |

FOREIGN PATENT DOCUMENTS

| | | |
|---|---|---|
| FR | 464.585 | 3/1914 |
| GB | 12040 | 6/1908 |

* cited by examiner

*Primary Examiner*—Anthony Knight
*Assistant Examiner*—Enoch Peavey

(57) ABSTRACT

A jewelry clasp has first and second elongated legs with a receptor at one end of one leg providing a pair of spaced side walls forming a channel-shaped recess for receiving the adjacent end of the other leg. At least one of the side walls has a portion projecting towards the other side wall to provide a restriction in the channel-shaped recess to reduce the width of the channel, and one of the side walls flexing as the other leg is pressed against the projecting portion to allow the other leg to pass thereby, to be retained in the channel by the projecting portion. The flexing and snap action generally produce an audible click to allow the user to conform that the leg is securely seated in the receptor.

9 Claims, 2 Drawing Sheets

CLASP FOR JEWELRY CHAIN

BACKGROUND OF THE INVENTION

The present invention relates to jewelry clasps and, more particularly, to a clasp for coupling the ends or extending the length of jewelry chains.

Loss of jewelry chains and of other types of jewelry utilizing chains is a fairly common occurrence which is generally caused by the failure of conventional clasps employed at the ends of such chains.

Frequently, individuals may seek to combine individual jewelry chains to obtain a desired visual impact or appearance. In one method of attachment, the individual utilizes the primary catch of each chain as the attachment point, and a failure of either primary catch, will result in potential loss of the combined chains. In some instances, a separate device has been employed to connect one jewelry chain to an adjacent chain to provide a fixed separation between chains and to secure the adjacent chains. Some of these devices have functioned as clamps which extend across the adjacent jewelry chains to secure them in spaced assembly. Although such a clamp device secures the adjacent chains, they are generally awkward to apply and difficult to adjust to different size chains worn simultaneously. "Safety pin" type devices have been used to support a single piece of jewelry on an article of clothing, However, these devices do not perform any safety-related function and are susceptible to failure if the spring leg opens.

It is an object of the present invention to provide a novel clasp for coupling multiple jewelry chains and the like which is easy to assemble to the chains and provides a high degree of security.

It is also an object to provide such a clasp which can be fabricated readily and which is relatively long lived.

Another object is to provide such a clasp which may be fabricated relatively economically from precious metal to provide an attractive appearance.

A further object is to provide such a clasp which can be used to extend the effective length of a jewelry chain.

SUMMARY OF THE INVENTION

It has now been found that the foregoing and related objectives may be readily attained in a jewelry clasp comprising first and second elongated legs and a receptor at one end of the first leg which provides a pair of spaced side walls forming a channel-shaped recess for receiving the adjacent end of the second leg. The recess is dimensioned to seat the adjacent end of the second leg snugly, and at least one of the side walls has a portion projecting towards the other of the side walls to provide a restriction in the channel-shaped recess to reduce the width of the recess to less than the width of the second leg. At least one of the side walls flexes as the second leg is pressed against the projecting portion to allow the second leg to pass thereby, and the second leg is retained in the recess by the projecting portion. The clasp also has means connecting the other ends of the first and second legs.

Preferably, one of the side walls of the receptor is of greater length than the other end and has its outer end bent over the other of the side walls to provide a restricted lateral opening into the channel-shaped recess through which the second leg may be introduced.

The legs are desirably integrally formed with a spring coiled portion at the other end thereof and it biases the one end of the second leg towards the first leg and the receptor. The flexing of the at least one side wall of the receptor to permit the second leg to pass by the projecting portion produces an audible clicking sound.

The clasp is easily used to provide a jewelry assembly with at least two elongated chains each having elements providing passages therethrough and the clasp has first and second elongated legs extending in spaced relationship with one leg extending through the passages in elements in each of the chains, whereby the chains are retained on the second leg between the receptor and the connecting means. Usually, the elements in the chains comprise loops at the ends thereof.

DETAILED DESCRIPTION OF THE PREFERRED EMBODIMENT

Figure 1:
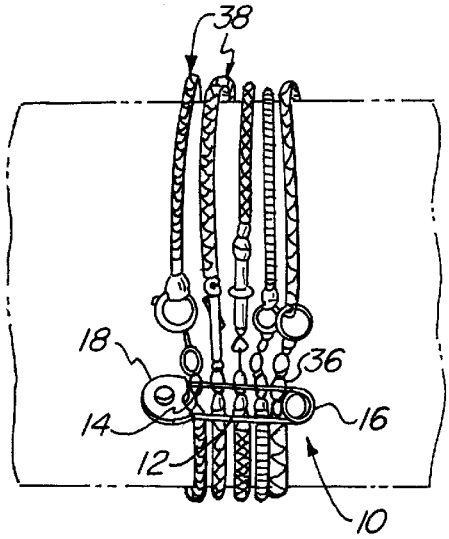
FIG. 1 illustrates a clasp embodying the present invention with the spring leg passing through eyelet loop elements of several jewelry chains.

Referring now in detail to FIG. 1 of the attached drawings, therein illustrated is a jewelry clasp embodying the present invention and generally designated by the numeral 10. The clasp 10 has a pair of legs 12, 14 integrally formed with a spring loop 16 at one end thereof and a receptor 18 at the other end of the leg 12.

Figure 5:
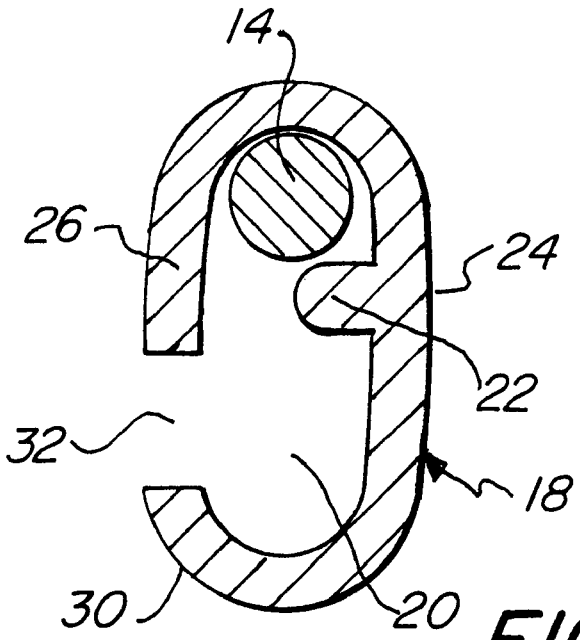
FIG. 5 is a cross sectional of the receptor element of FIG. 1 drawn to an enlarged scale with a leg secured therein.
Figure 6:
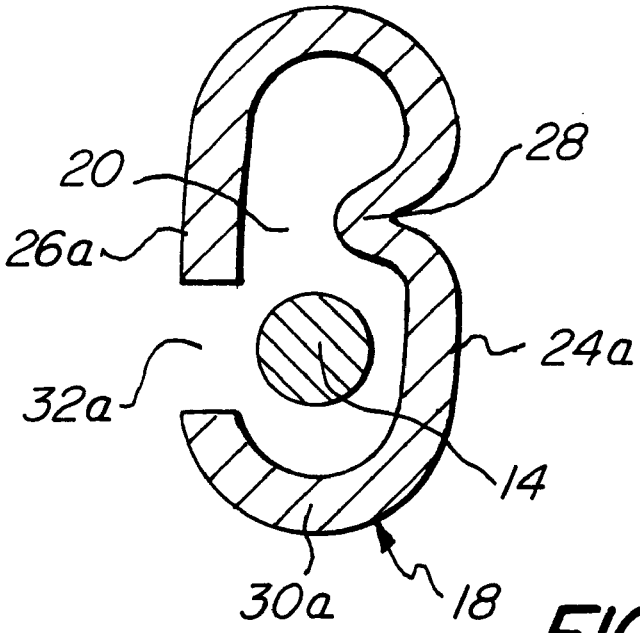
FIG. 6 is a similar view of another embodiment of receptor element with a leg about to be pushed into the retention area.

As seen in FIGS. 5 and 6, the receptor 18 provides a channel shaped recess 20 in which the adjacent end of the leg 14 is seated snugly. In the embodiment of FIG. 5, the receptor 18 has a projection 22 on one side wall 24 which provides a restriction in the channel 20 defined between it and the side wall 26 to reduce the spacing to less than the diameter of the leg 14. In the embodiment of FIG. 6, the side wall 24a is deformed to provide a boss or projection 28 which provides the restriction in the channel of the recess 20.

As seen in FIGS. 5 and 6, the side wall 24 is of greater length than the side wall 26 and is formed with a U-shaped or reversely extending end portion 30 which is spaced from the side wall 26 to provide a lateral opening 32 into the channel 20.

In either of the embodiments of FIGS. 5 and 6, the leg 14 of the clasp 10 is of larger diameter than the width of the restricted portion of the passage in the channel 20. Thus, when the leg 14 is introduced into the channel 20 through the laterally opening 32 and pressed against the projection 22 or boss 28, either or both of the side walls 24, 26 are resiliently deflected to permit the leg 14 to pass through the restriction and resiliently snap back as it passes thereby, and this will usually produce a clicking noise.

In this fashion, the user can tell that the leg is seated behind the projection 22 or boss 28. Similarly, a clicking sound will be made by movement outwardly through the restriction and this may alert the user to the opening of the clasp.

Figure 2:
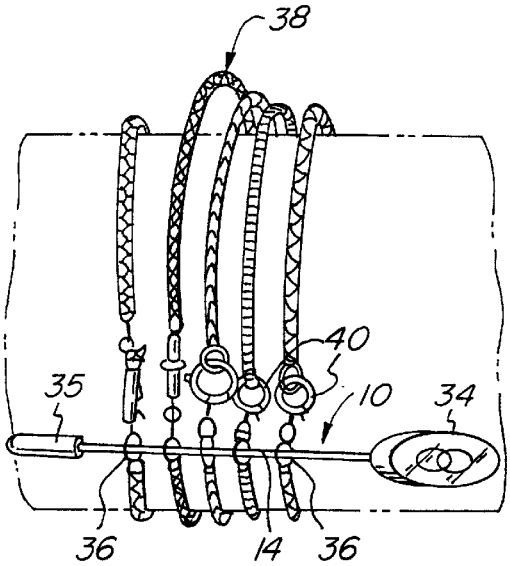
FIG. 2 illustrates an alternate embodiment of the clasp of the present invention in which ornamental fittings are provided on each end.
Figure 3:
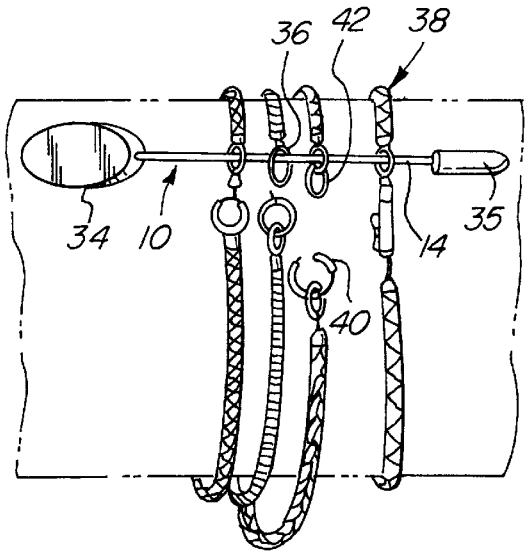
FIG. 3 schematically illustrates the embodiment of FIG. 2 retaining the chains in assembly upon failure of one of the chain clasps.
Figure 4:
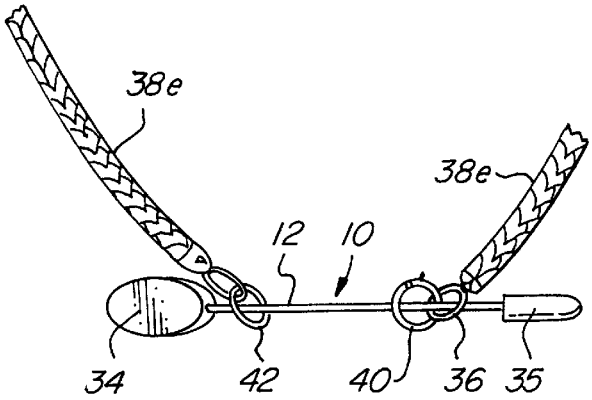
FIG. 4 illustrates the clasp embodiment of FIG. 2 used to join the ends of a single jewelry chain and thereby extend its effective length.

In the embodiment shown in FIGS. 2–4, the spring loop end of the clasp has an ornamental element 34 seated thereon. If so desired, the receptor 18 may be enlarged or also encased within an ornamental element 35.

As seen in FIGS. 1 and 2, the leg 14 is inserted through a link or loop element 36 in each of the several chains generally designated by the numeral 38, and these link elements 36 are preferably the separate soldered eyelet loops connected by a jump ring to the conventional clasp elements 40, 42. If none is available, then the leg 14 should be passed through the closed ring 42 or of the clasp 10. In the event of failure of the opening clasp ring 40 or of a link in a link chain, the chains 38 will still be engaged as seen in FIG. 4.

As will be appreciated, the several chains 38 are held in assembly along the length of the leg 14 between the elements 34 and 35 which will not permit the loops 36 to pass thereby. In FIG. 4, the clasp 10 is utilized to extend the length of the chain 38 by passing it through the link element 36 adjacent one end of the chain 38e and through the closed ring 42 of the regular clasp. In this manner, the effective length of the chain 38 is increased by the length of the leg 14 between the end elements 34 and 35.

As will be appreciated, the clasp may be readily fabricated from wire stock and sheet metal stock, and precious metals or metal castings may be utilized since the amount of metal required is relatively small depending upon the thickness and dimensions of the components.

The wire forming the loop and legs should be heat treated to provide the desired spring action and resiliency. Preferably, the spring loop should be formed to bias the other end of the legs toward each other so as to improve the security of the engagement of the leg in the receptor.

The receptor projection can be provided by the deposit of metal solder on the side wall or as part of a casting. Alternatively, a sheet metal side wall can be deformed by a punch to provide a boss.

Thus it can be seen from the foregoing detailed description and attached drawings that the clasp of the present invention may be readily and relatively economically fabricated as an ornamental piece which secures plural chains in assembly, or extends the length of a single chain.

Having thus described the invention, what is claimed is:

1. A jewelry clasp comprising:

(a) first and second elongated legs;

(b) a receptor at one end of said first leg and having a pair of spaced side walls providing a channel-shaped recess for receiving the adjacent end of said second leg, said recess being dimensioned to seat said adjacent end of said second leg snugly, at least one of said side walls having a portion projecting transversely of said channel-shaped recess towards the other of said side walls at a point spaced from the base of said channel to provide a retention area therebelow and to provide a restriction in said channel-shaped recess to reduce the width of the channel to less than the width of said second leg, at least one of said side walls flexing outwardly as said second leg is pressed against said projecting portion to allow said second leg to pass thereby, said second leg being retained in said retention area of said channel-shaped recess by said projecting portion after said second leg has passed thereby towards the base of said channel; and (c) means connecting the other ends of said first and second legs.

2. A jewelry clasp comprising:

(a) first and second elongated legs;

(b) a receptor at one end of said first leg and having a pair of spaced side walls providing a channel-shaped recess for receiving the adjacent end of said second leg, said recess being dimensioned to seat said adjacent end of said second leg snugly, one of the side walls of said receptor is of greater length than the other end and has its outer end bent over the other of said side walls to provide a restricted lateral opening into said channel through which said second leg may be introduced, at least one of said side walls having a portion projecting towards the other of said side walls to provide a restriction in said channel-shaped recess to reduce the width of the channel to less than the width of said second leg, at least one of said side walls flexing as said second leg is pressed against said projecting portion to allow said second leg to pass thereby, said second leg being retained in said channel-shaped recess by said projecting portion; and (c) means connecting the other ends of said first and second legs.

3. A jewelry clasp in accordance with claim 1 wherein said legs are integrally formed with a spring coiled portion at said other ends thereof, said spring coiled portion biasing said one end of said second leg towards said first leg and said receptor.

4. A jewelry clasp in accordance with claim 1 wherein the flexing of said one side wall of said receptor to permit said second leg to pass by said projecting portion produces an audible clicking sound.

5. A jewelry assembly comprising:

(a) at least two elongated chains each having elements providing passages therethrough; and (b) a clasp having:

(i) first and second elongated legs extending in spaced relationship and through passages in elements in each of said chains;

(ii) a receptor at one end of said first leg and having a pair of spaced side walls providing a channel-shaped recess for receiving the adjacent end of said second leg, said recess being dimensioned to seat said adjacent end of said second leg snugly, at least one of said side walls having a portion projecting transversely of said channel shaped recess towards the other of said side walls at a point spaced from the base of said channel to provide a retention area therebelow and to provide a restriction in said channel-shaped recess to reduce the width of the channel to less than the width of said second leg, at least one of said side walls flexing outwardly as said second leg is pressed against said projecting portion to allow said second leg to pass thereby, said second leg being retained in said retention area of said channel-shaped recess by said projecting portion after said second leg has passed thereby towards the base of said channel; and (iii) means connecting the other ends of said first and second legs, whereby said chains are retained on said second leg between said receptor and said connecting means.

6. A jewelry assembly comprising:

(a) at least two elongated chains each having elements providing passages therethrough; and (b) a clasp having:

(i) first and second elongated legs extending in spaced relationship and through passages in elements in each of said chains;

(ii) a receptor at one end of said first leg and having a pair of spaced side walls providing a channel-shaped recess for receiving the adjacent end of said second leg, said recess being dimensioned to seat said adjacent end of said second leg snugly, one of the side walls of said receptor being of greater length than the other end and having its outer end bent over the other of said side walls to provide a restricted lateral opening into said channel through which said second leg may be introduced, at least one of said side walls having a portion projecting towards the other of said side walls to provide a restriction in said channel-shaped recess to reduce the width of the channel to less than the width of said second leg, at least one of said side walls flexing as said second leg is pressed against said projecting portion to allow said second leg to pass thereby, said second leg being retained in said channel-shaped recess by said projecting portion; and (iii) means connecting the other ends of said first and second legs, whereby said chains are retained on said second leg between said receptor and said connecting means.

7. The jewelry assembly in accordance with claim 5 wherein said legs are integrally formed with a spring coiled portion at other ends thereof, said spring coiled portion biasing said one end of said second leg towards said first leg and said receptor.

8. The jewelry assembly in accordance with claim 5 wherein the flexing of said one side wall of said receptor to permit said second leg to pass by said projecting portion produces an audible clicking sound.

9. The jewelry assembly in accordance with claim 5 wherein said elements in said chains comprise loops at the ends thereof.

* * * * *